US006237649B1

(12) United States Patent
Moisio et al.

(10) Patent No.: US 6,237,649 B1
(45) Date of Patent: May 29, 2001

(54) DUAL VIAL CONNECTING SYSTEM FOR LYOPHILIZED PRODUCTS

(75) Inventors: Franck Moisio, Kembs (FR); Franz A Klug, Bubendorf (CH)

(73) Assignee: Pentapharm AG (CH)

( * ) Notice: Subject to any disclaimer, the term of this patent is extended or adjusted under 35 U.S.C. 154(b) by 0 days.

(21) Appl. No.: 09/486,566

(22) PCT Filed: Aug. 27, 1997

(86) PCT No.: PCT/EP97/04660

§ 371 Date: Feb. 25, 2000

§ 102(e) Date: Feb. 25, 2000

(87) PCT Pub. No.: WO99/09931

PCT Pub. Date: Mar. 4, 1999

(51) Int. Cl.[7] ..... A61J 1/00; B65D 81/32

(52) U.S. Cl. ..... 141/100; 141/18; 141/319; 141/329; 141/383

(58) Field of Search ..... 141/9, 18, 21, 141/25–27, 100, 319–322, 329, 330, 383, 384

(56) References Cited

U.S. PATENT DOCUMENTS

| | | | | |
|---|---|---|---|---|
| 3,917,063 | * | 11/1975 | Chibret et al. | 141/329 |
| 4,573,506 | * | 3/1986 | Paoletti | 141/27 |
| 4,834,149 | * | 5/1989 | Fournier et al. | 141/27 |
| 4,986,322 | * | 1/1991 | Chibret et al. | 141/319 |
| 5,247,972 | * | 9/1993 | Tetreault | 141/27 |
| 5,348,060 | * | 9/1994 | Futagawa et al. | 141/100 |
| 5,526,853 | * | 6/1996 | McPhee et al. | 141/329 |
| 5,531,254 | * | 7/1996 | Rosenbach | 141/21 |
| 5,566,729 | * | 10/1996 | Grabenkort et al. | 141/25 |
| 5,595,314 | * | 1/1997 | Weiler | 141/384 |
| 5,702,019 | * | 12/1997 | Grimard | 141/383 |
| 5,743,312 | * | 4/1998 | Pfeifer et al. | 141/329 |

FOREIGN PATENT DOCUMENTS

| | | |
|---|---|---|
| 0 283 629 | 9/1988 | (EP) . |
| 2 188 565 | 1/1974 | (FR) . |
| 2 427 960 | 1/1980 | (FR) . |
| 2 682 088 | 4/1993 | (FR) . |

* cited by examiner

*Primary Examiner*—J. Casimer Jacyna
(74) *Attorney, Agent, or Firm*—Pennie & Edmonds LLP

(57) ABSTRACT

For temporary connection of two containers (1, 3) such as vials, bottles, etc. . . . , with guaranteed tightness thanks to a cylindrical screwing closing and connection plastic sleeve (4) having a plastic perforable membrane (7) located between its upper portion (6) and lower portion (5) including an elastomer sealing ring (13) fixed around a cylindrical plastic skirt (12) located in the inner lower portion (5), and an elastomer sealing plug (18) fixed by the collar (17) and the annular rib (16) in the inner upper portion (6), a cylindrical plastic skirt (12) coming in contact with the inner neck (10) of the glass or plastic vial (1), the whole assuring complete tightness of the system when stored and when used for the reconstitution of the product (2) contained in a glass or plastic vial (1) with a corresponding solvent (23) contained in a plastic solvent bottle (3).

6 Claims, 7 Drawing Sheets

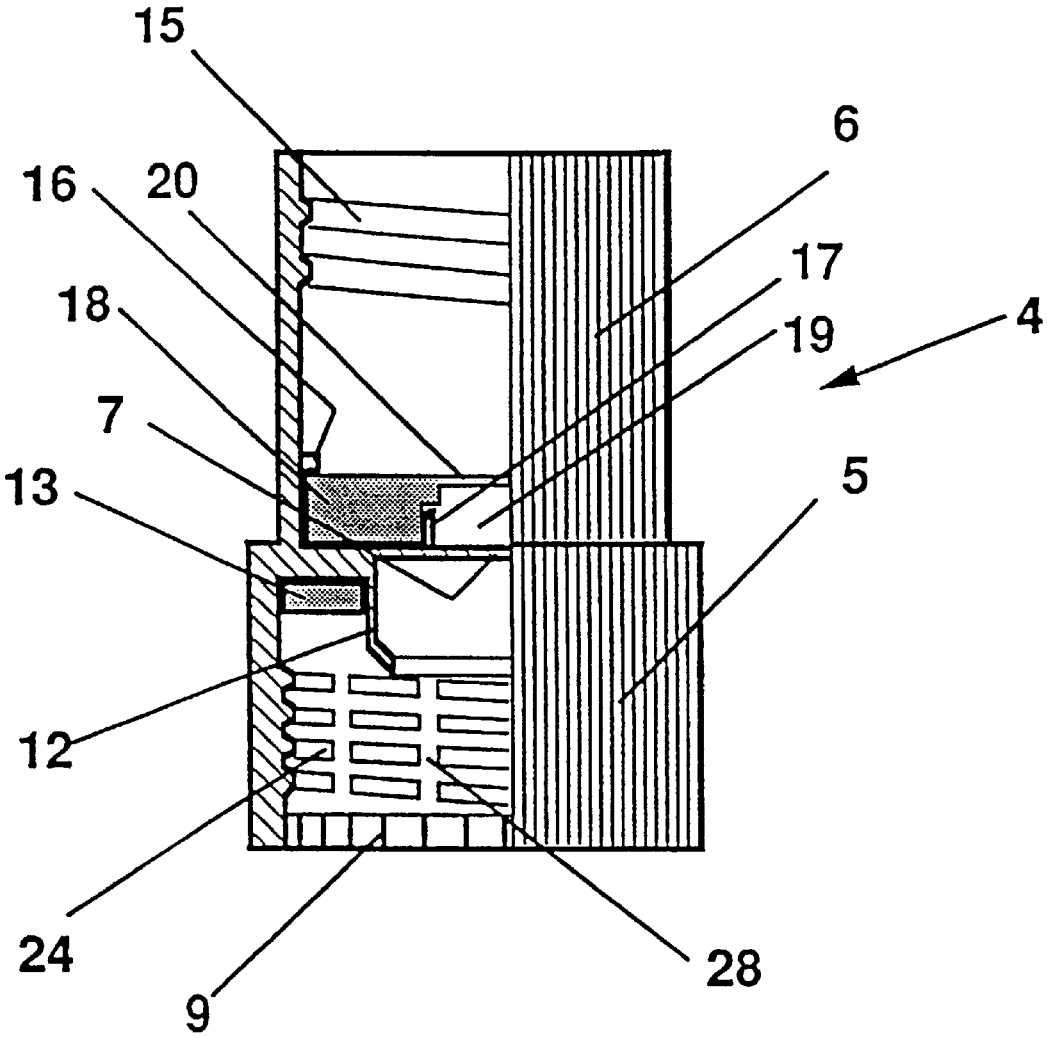
Fig. 2
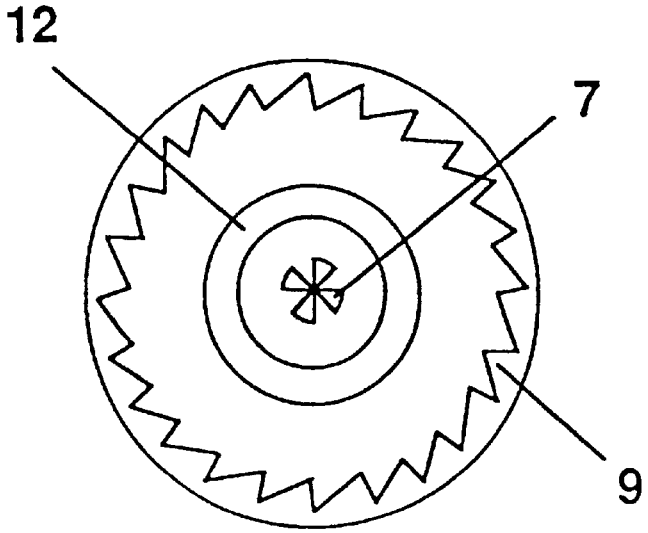

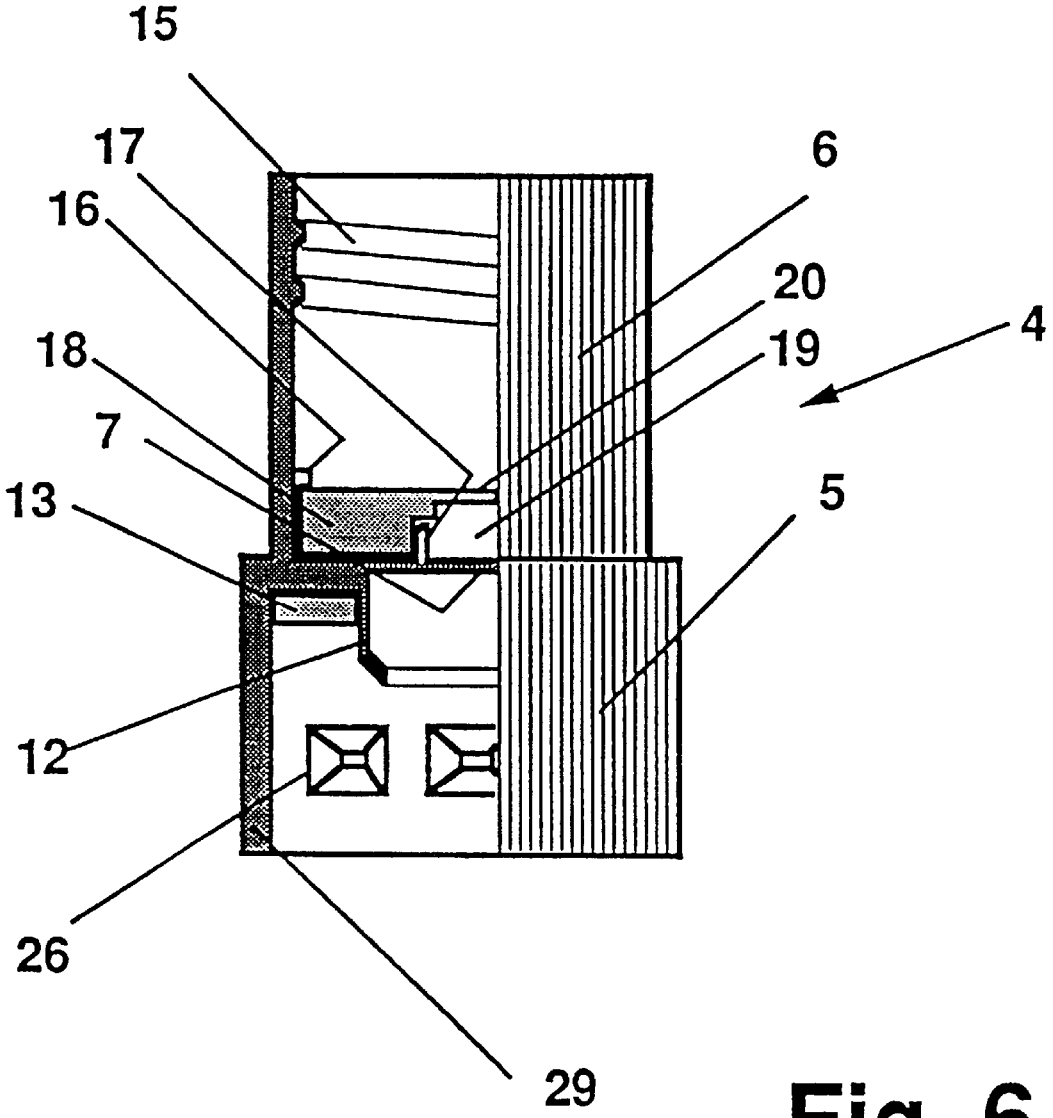
Fig. 6
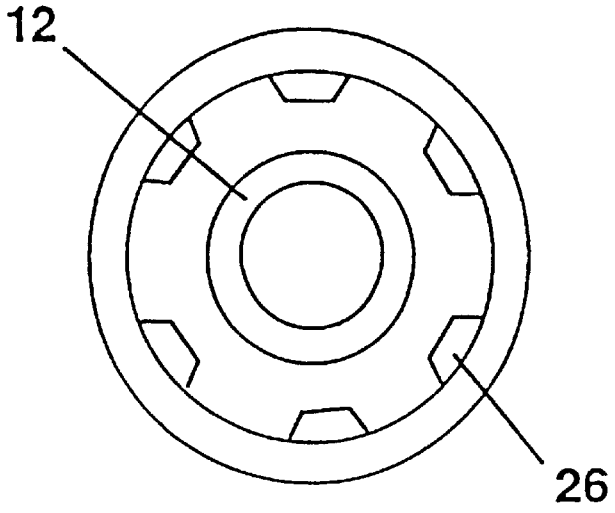

DUAL VIAL CONNECTING SYSTEM FOR LYOPHILIZED PRODUCTS

BACKGROUND OF THE INVENTION

The present invention concerns in a dual vial connecting system for temporary connection of two containers, usually a glass or plastic vial and a plastic solvent bottle, the purpose being to reconstitute a dry product, such as a lyophilisate, powder etc., contained in a glass or plastic vial with a corresponding solvent product contained in a plastic solvent bottle, the connecting system having a cylindrical closing and connecting plastic sleeve with a lower portion having inwardly directed securing means for secure connection with the neck of the glass or plastic vial, an upper portion having an internal thread for screwing connection with the plastic solvent bottle and an integrated plastic membrane being perforated by the orifice reducer of the plastic solvent bottle when screwed into the upper inner threaded portion of the closing and connecting plastic sleeve.

For reasons of stability, freshness, marketing aspects, etc., the two products are kept and stored in separate containers prior to their immediate use. During storage, the two containers are hermetically closed.

BRIEF SUMMARY OF THE INVENTION

The aim of the present invention is a dual connecting container system which does not require a rubber stopper but ensures a tight closure of the glass or plastic vial containing the lyophilisate etc., as well as a tight connection between the glass or plastic vial and the solvent bottle during the reconstitution phase.

According to the invention, this is achieved by the closing and connecting plastic sleeve having a perforable membrane separating the upper inner threaded portion from the lower portion of the closing and connecting plastic sleeve, an inner cylindrical skirt located in the inner lower portion of the closing and connecting plastic sleeve and extending downwardly from the lower surface of the perforable membrane said skirt having an outer diameter coming in contact with the wall of the inner neck of the glass or plastic vial, an elastomer sealing ring fixed at the uppermost position around the outer surface of the said skirt, an elastomer sealing plug with a pre-cut section and a cavity in its centre, the said sealing plug being placed around a cylindrical collar located in the inner upper portion of the closing and connecting plastic sleeve and extending upwardly from the upper surface of the perforable membrane, whereby the perforable membrane, the cylindrical skirt and the collar are integrally moulded parts of the said closing and connecting plastic sleeve.

According to a preferred embodiment of the invention the securing means comprises a threaded inner wall of the inner lower portion for engaging a corresponding thread on the outer surface of the glass or plastic vial neck. As a safeguard against removal of the closing and connecting plastic sleeve from the glass or plastic vial, the inner wall is provided with cogs engaging corresponding cogs on the outer surface of the glass or plastic vial neck. Moreover, the thread is interrupted by vertical grooves for keeping an open connection from the glass or plastic vial interior to the outside when the closing and connecting plastic sleeve is only partially screwed onto the said vial.

According to an alternative embodiment of the invention, the lower portion of the closing and connecting plastic sleeve has inwardly directed projections for snapping connection with an annular bulge around the outer surface of the neck of the glass or plastic vial.

According to another preferred embodiment, the elastomer sealing plug has a cavity in its center leaving a thinned area which functions as an elastomer membrane which is pre-cut in its center. When screwing the plastic solvent bottle into the upper inner threaded portion of the closing and connecting plastic sleeve, the orifice reducer of the said plastic solvent bottle first penetrates through the pre-cut area of the said sealing plug and then perforates the plastic membrane of the closing and correcting plastic sleeve.

Once the solvent bottle is completely screwed into the closing and connecting plastic sleeve, the wall of the orifice reducer come in contact with the wall of the cavity of the said sealing plug which assures a complete tightness between the two containers, the plastic solvent bottle is then squeezed in order to transfer the solvent product into the glass or plastic vial containing the lyophilisate, powder etc.,. When the reconstitution of the lyophilized product, forming the final product, is completed by shaking the assembly, the assembly is then inverted, having now the glass or plastic vial on top, the recalling of the reconstituted final product into the plastic solvent bottle can be achieved by squeezing and releasing the plastic solvent bottle again several times.

According to another embodiment of the present invention, the inner wall of the upper threaded portion of the closing and connecting plastic sleeve has an annular rib that operates as a snap and allowing to hold the sealing elastomer plug in place. The elastomer sealing ring assures a tightness when the closing and connecting plastic sleeve is completely screwed onto the threaded neck of the glass or plastic vial and comes in contact with the top surface of the neck of the said glass or plastic vial.

In the following preferred embodiments of the invention are described with regard to the accompanying drawings, wherein:

BRIEF DESCRIPTION OF THE DRAWINGS

FIG. 2 shows the closing and connecting plastic sleeve.

FIG. 6. shows the closing and connecting plastic sleeve of the alternative embodiment.

DETAILED DESCRIPTION OF THE INVENTION

Figure 1:
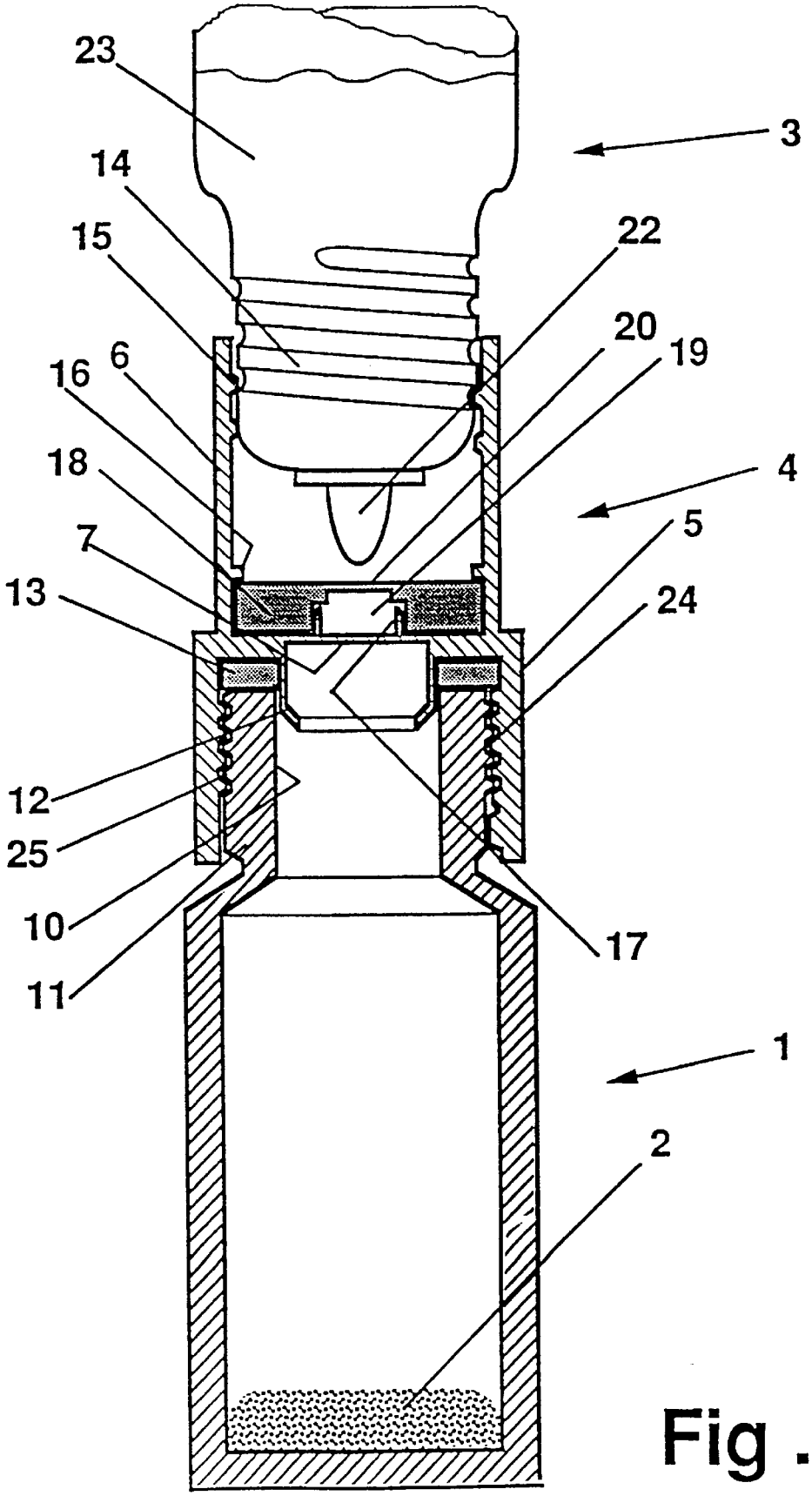
FIG. 1 shows a schematic representation of the dual vial connecting system according to the invention.

A glass or plastic vial 1 contains a solid product 2 such as a lyophilisate, powder, etc. In order to obtain a ready to use solution, the lyophilisate product 2 has to be mixed or redissolved with a solvent 23 stored separately in a plastic solvent bottle 3 made of a flexible material. For the mixing and reconstitution process, the two containers 1 and 3 have to be connected in such a way that the solvent 23 may be transferred into the glass or plastic vial 1 containing the lyophilisate 2 and where the mixing and reconstitution takes place. After shaking the solution contained in the glass or plastic vial 1, the assembly is inverted, having now the glass or plastic vial 1 on top so that the solution may be retransferred into the plastic solvent bottle 3 by squeezing and releasing the said plastic solvent bottle 3 several times. During this entire process, no liquid must be lost and no leakage must occur.

Figure 4:
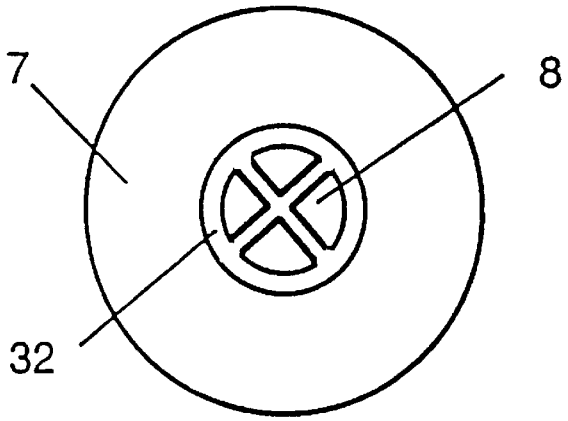
FIG. 4 shows the perforable plastic membrane with notches and weakness zones.
Figure 9:
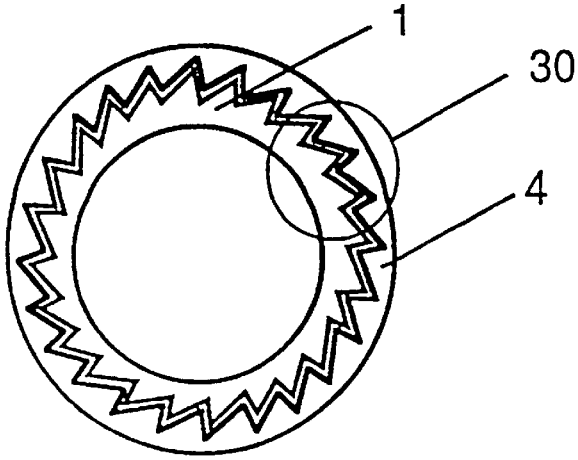
FIG. 9. shows the security blocking system.

A closing and connecting plastic sleeve 4 has a cylindrical shape and consists of a lower inner threaded portion 5 and an upper inner threaded portion 6 separated from each other by a perforable plastic membrane 7 which is an integral part of the closing and connecting plastic sleeve 4. As it will be explained, the plastic perforable membrane 7 is perforated by the orifice reducer 22 of the plastic solvent bottle 3 during connection of the two containers 1 and 3. In order to facilitate the perforation by the orifice reducer 22 of the plastic bottle 3, the plastic perforable membrane 7 (FIG. 4), has in its center notches 8 forming characteristic weakness zones 32 that will break more easily under the pressure of the orifice reducer 22 of the plastic solvent bottle 3 when screwed in the upper inner threaded portion 6 of the closing and connecting plastic sleeve 4.

The lower portion 5 of the closing and connecting plastic sleeve 4 has on its inner wall a thread 24 that fits with the counter-thread 25 of the neck of the glass or plastic vial 1. Below the inner thread 24 in the lower portion 5 of the closing and connecting plastic sleeve 4, a security blocking system 30 is build in the inner wall periphery characterized by cogs 9 having a slight inclination in order to facilitate the screwing of the closing and connecting plastic sleeve 4 when in contact with the neck of the glass or plastic vial 1 also characterized by cogs 11 having a slight inclination. When screwing the closing and connecting plastic sleeve 4 onto the glass or plastic vial 1 is completed, it becomes then impossible to unscrew the closing and connecting plastic sleeve 4 off the glass or plastic vial 1 thanks to the shaped cogs 9 and 11 fitting into each other.

Tightness between the closing and connecting plastic sleeve 4 and the top surface neck of the glass or plastic vial 1 is ensured by two co-operating features: An inner cylindrical plastic skirt 12 that extends downwardly from the plastic perforable membrane surface 7 and having an outer diameter fitting in the inner portion neck 10 of the glass or plastic vial 1. The inner cylindrical plastic skirt 12 is an integral part of the closing and connecting plastic sleeve 4. The second feature for effective tightness is an elastomer sealing ring 13 placed at the uppermost position around the outer surface of the inner extending downwardly extending cylindrical plastic skirt 12 inside the lower portion 5 of the closing and connecting plastic sleeve 4.

The upper portion 6 of the closing and connecting plastic sleeve 4 has an inner diameter adapted to receive the plastic solvent bottle 3. For the purpose of perfect connection, the inner wall of the upper portion 6 of the closing and connecting plastic sleeve 4 is provided with a thread 15 which fits with the counter-thread 14 of the plastic solvent bottle 3.

Below the inner thread 15 in the upper portion 6 of the closing and connecting plastic sleeve 4 an annular rib 16 is located, operating as a snap and holding the sealing elastomer plug 18 in place.

Figure 3:
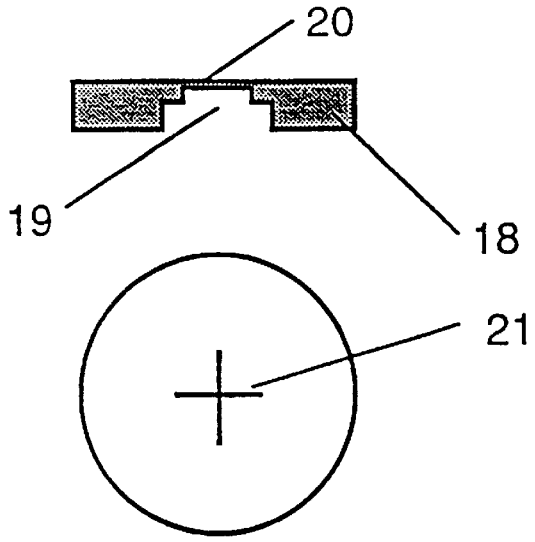
FIG. 3 shows an elastomer sealing plug with a pre-cut area.

On the upper periphery surface of the plastic perforable membrane 7, separating the upper portion 6 from the lower portion 5 of the closing and connecting plastic sleeve 4 an inner cylindrical integral plastic collar 17 extending upwardly and fitting in the cavity 19 of the elastomer sealing plug 18 is holding in place the said sealing plug 18. This elastomer sealing plug 18 with a cavity 19 below its center which therefore functions as a thin elastomer membrane 20 has pre-cut cross lines 21 in its center (FIG. 3).

The elastomer sealing plug 18 is snapped in between the annular rib 16 and the inner upwardly extending plastic collar 17, both located in the upper inner portion 6 of the closing and connecting plastic sleeve 4 for safe and exact positioning reasons. The elastomer sealing plug 18 prevents gas exchanges that may occur via the plastic perforable membrane 7 and of having direct contact with the plastic perforable membrane 7 with any kind of pollution or particles.

When the plastic solvent bottle 3 is screwed into the upper inner threaded portion 6 of the closing and connecting plastic sleeve 4, its orifice reducer 22 first penetrates through the pre-cut area 21 of the elastomer sealing plug 18, then perforates the perforable plastic membrane 7 and assures complete tightness by being in contact with the wall of the centered cavity 19 of the elastomer sealing plug 18. The two containers 1 and 3 are now connected and the transfer of the solvent product 23 contained in the plastic solvent bottle 3 into the glass or plastic vial 1 containing the lyopliilisate 2 can be achieved by squeezing and releasing the plastic solvent bottle 3 several times. After reconstitution, the solution can be retransferred into the plastic solvent bottle 3 by inverting the assembly, the glass or plastic vial 1 being on top, by squeezing and releasing the plastic solvent bottle 3 again several times. The whole procedure can be accomplished without any spilling or leakage.

Figure 7:
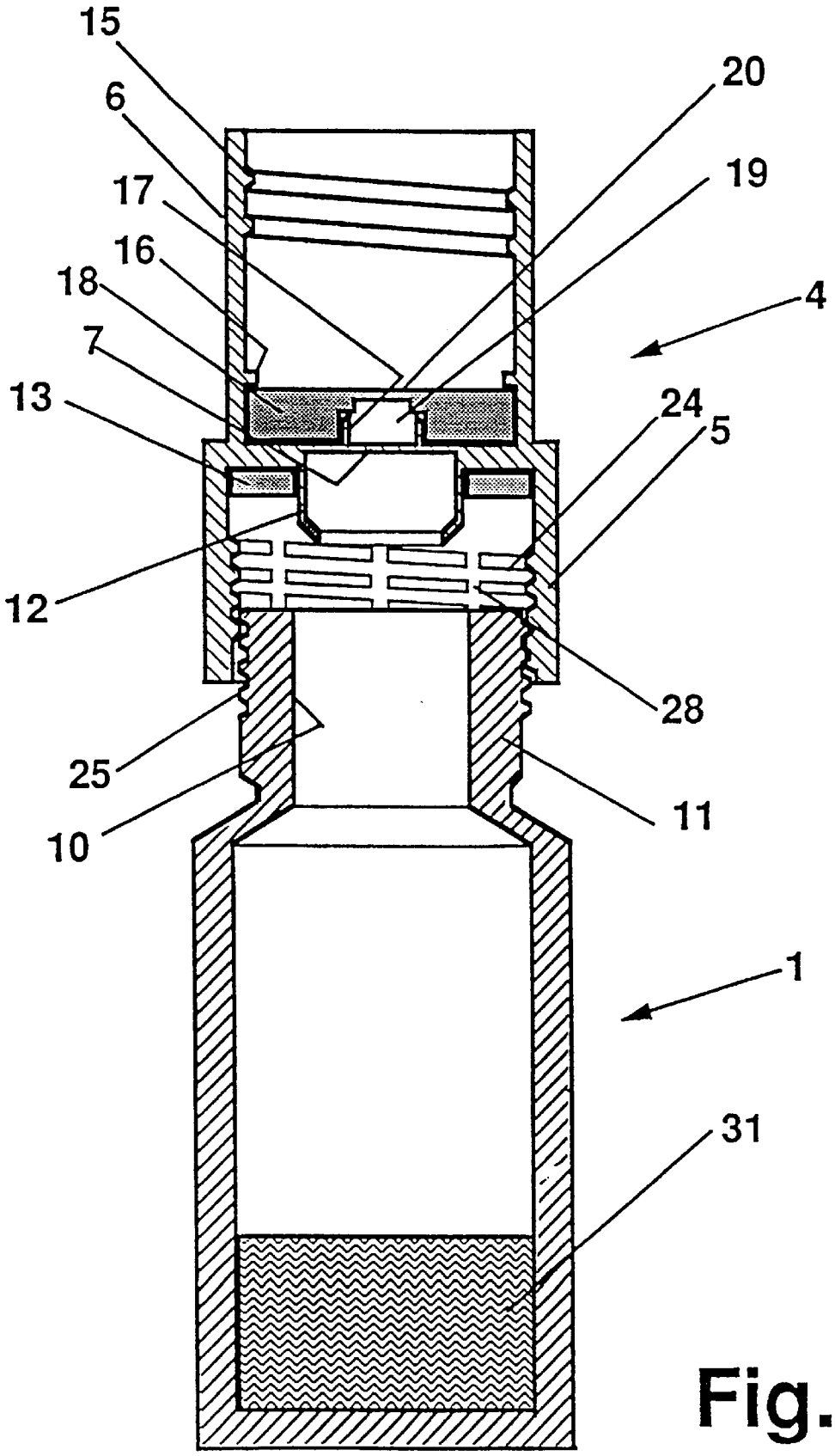
FIG. 7. shows the dual vial connecting system during lyophilization process.

Another advantage of the present invention is its special suitability for lyophilisation process. Prior to lyophilization ,the glass or plastic vial 1 is filled with a liquid active 31 (FIG. 7). The closing and connecting plastic sleeve 4 is slightly screwed onto the thread 25 of the neck of the glass or plastic vial 1. The cylindrical inner plastic skirt 12 located in the inner lower portion 5 of the closing and connecting plastic sleeve 4 is in this case not yet in contact with the wall 10 of the inner neck of the glass or plastic vial 1. Then the glass or plastic vial 1 with its liquid active 31 and its closing and connecting plastic sleeve 4, which remains not completely screwed, is placed into the freeze-dryer for lyopilization.

As can be seen in (FIG. 2) the inner thread 24 located in the lower inner portion 5 of the closing and connecting plastic sleeve 4 is interrupted by vertical grooves 28 which have the function of escape or evacuation channels needed during the lyophilization process to insure the removal of the moisture or liquid in gas form. Once the lyophilization cycle is completed, the closing and connecting plastic sleeve 4 is completely screwed onto the glass or plastic vial 1. These production steps may be preformed fully automatically.

The cogs 11 located below the thread 25 on the neck of the glass or plastic vial 1 in combination with the cogs 9 of the closing and connecting plastic sleeve 4, constitute the security blocking system 30 (FIG. 10) which has the advantage of preventing the removal of the closing and connecting plastic sleeve 4 by manual means one completely screwed onto the glass or plastic vial 1.

Figure 5:
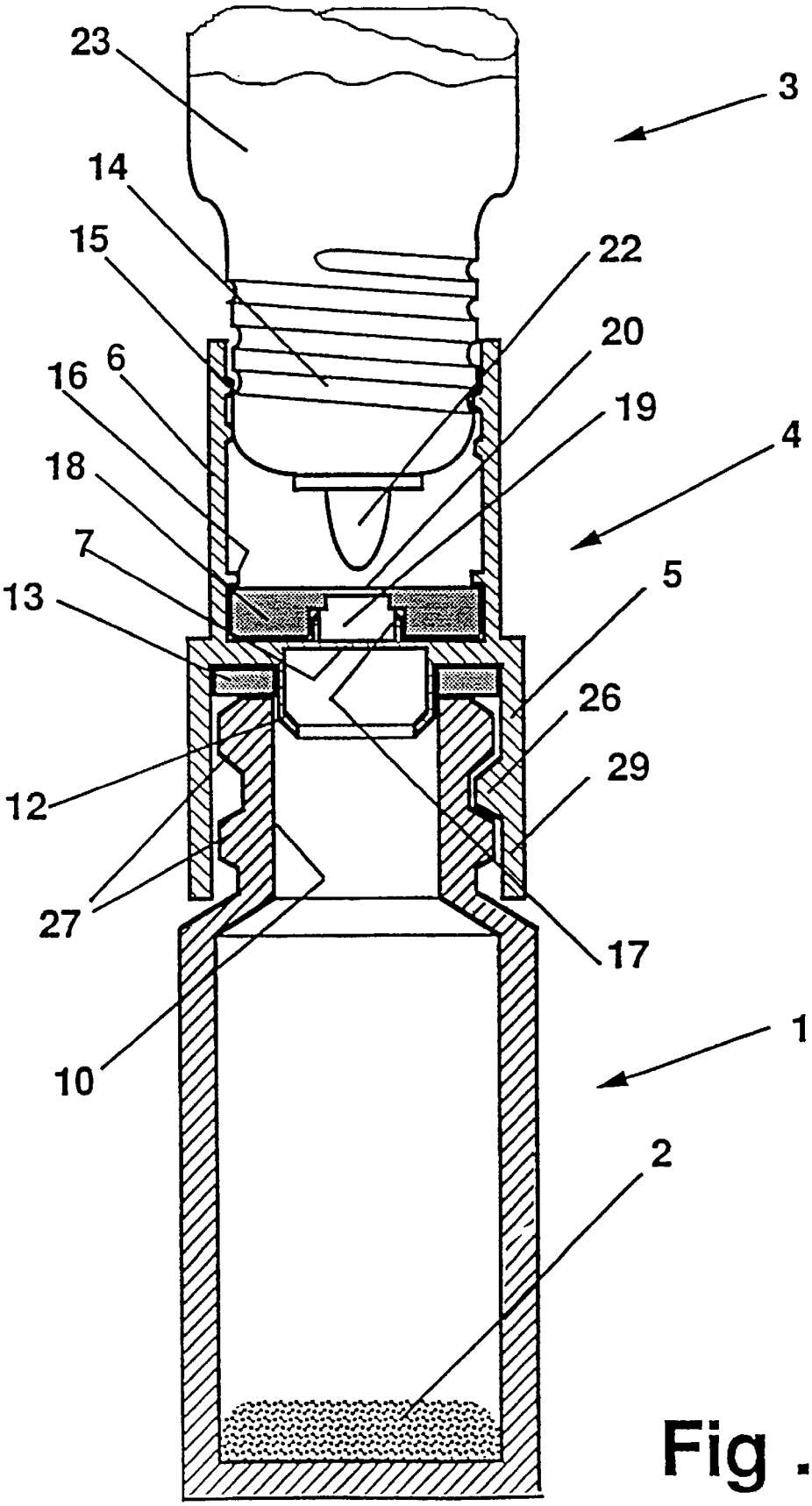
FIG. 5. shows an alternative embodiment of a dual vial connecting system according to the invention.
Figure 8:
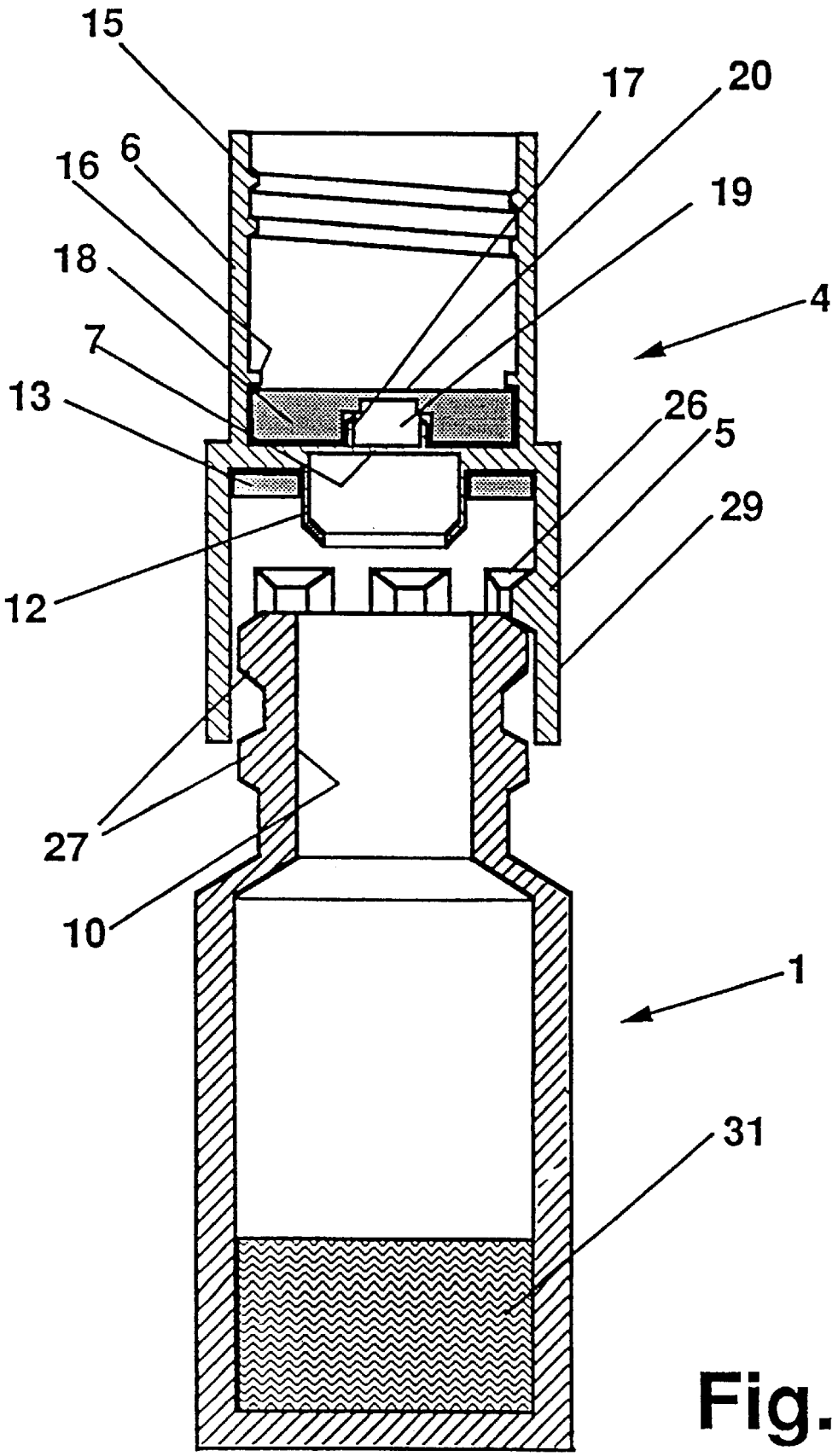
FIG. 8. shows the alternative embodiment during lyophilization process.

FIGS. 5,6 and 8 show an alternative embodiment of the invention. In the description of these figures the same elements are designated with the same reference numerals. In this alternative embodiment the lower portion 5 of the closing and connecting plastic sleeve 4 has on its inner wall a number of annularly arranged projections 26 defining an inner diameter fitting in between the two annular bulges 27 on the outside of the neck of the glass or plastic vial 1. This configuration constitutes a snap-in attachment of the closing and connecting plastic sleeve 4 on the said vial 1.

The wall of the lower portion 5 of the closing and connecting plastic sleeve 4 is extended below the projections 26 to form a kind of skirt 29 which is adapted to hold the closing and connecting plastic sleeve 4 in the position shown in (FIG. 8) which is described hereinafter.

As in the already described embodiment, tightness between the closing and connecting plastic sleeve 4 and the neck of the glass or plastic vial 1 is ensured by two co-operating features, i.e. the inner skirt 12 and the elastomer sealing ring 13.

The upper portion 6 of the closing and connecting plastic sleeve 4 shown in (FIGS. 5,6 and 8) is identical to that of the other embodiment (FIGS. 1,2, and 7).

This alternative embodiment is also characterised by its special suitability for fully automatically lyophilisation process. Prior to lyophilization, the glass or plastic vial 1 is filled with a liquid active 31. The closing and connecting plastic sleeve 4 is placed on top of the first bulge 27 of the glass or plastic vial 1. It remains positioned on the neck of the glass or plastic vial 1 due to the extended skirt 29 and projections 26 which allow to maintain the closing and connecting plastic sleeve 4 unsnapped during the lyophilization cycle. Then the glass or plastic vial 1 with its closing and connecting sleeve 4, which is not snapped, is placed in the freeze-dryer for lyoplilization.

The lateral spaces between the annularly arranged projection 26 located in the inner lower portion 5 of the closing and connecting plastic sleeve 4 provide open contact between the interior of the glass or plastic vial 1 and its surrounding and thus guarantee evaporation of the moisture or liquid during lyophilization cycle.

When the lyophilization cycle is completed, the closing and connecting plastic sleeve 4 is snapped onto the glass or plastic vial 1 inside the freeze-dryer. These production steps may be performed fully automatically.

The specifically shaped dual bulges 27 on the glass or plastic vial neck in combination with the annularly arranged projections 26 of the closing and connecting plastic sleeve 4 have the added advantage of preventing also the removal of the said closing and connecting plastic sleeve 4 by manual means.

What is claimed is:

1. A dual vial connecting system for temporarily connecting a glass or plastic vial and a plastic solvent bottle comprising:

a cylindrical closing and connecting plastic sleeve with a lower portion having inwardly directed securing means for secure connection with the neck of the glass or plastic vial, wherein an upper portion has an internal thread for screwing connection with the plastic solvent bottle and an integrated plastic membrane which is perforated by the orifice reducer of the plastic solvent bottle when screwed into the upper inner threaded portion of the closing and connecting plastic sleeve, said connecting system being characterized by:

the closing and connecting plastic sleeve having a perforable membrane separating the upper inner threaded portion from the lower portion of the closing and connecting plastic sleeve;

an inner cylindrical plastic skirt located in the inner lower portion of the closing and connecting plastic sleeve and extending downwardly from the lower surface of the perforable membrane;

said skirt having an outer diameter coming in contact with the wall of the inner neck of the glass or plastic vial;

an elastomer sealing ring fixed at the uppermost position around the outer surface of the said skirt; and an elastomer sealing plug with a pre-cut section and a cavity in its center;

said sealing plug being placed around a cylindrical collar located in the upper inner portion of the closing and connecting plastic sleeve and extending upwardly from the upper surface of the perforable membrane and held in place by an annular rib, whereby the perforable membrane, the cylindrical skirt, the collar and the annular rib are integrally molded parts of the said closing and connecting plastic sleeve.

2. The connecting system according to claim 1, characterized by a thread in the lower inner portion of the closing and connecting plastic sleeve for engaging a corresponding thread on the outer surface neck of the glass or plastic vial.

3. The connecting system according to claim 2, characterized by a security blocking system, constituted of cogs with a slight inclination build in the lower inner wall periphery portion of the closing and connecting plastic sleeve, and cogs with a slight inclination located below the thread of the glass or plastic vial.

4. The connecting system according to claim 2, characterized by the thread in the lower inner portion of the closing and connecting plastic sleeve being interrupted by vertical grooves for keeping an open space from the vial interior to the outside when the closing and connecting plastic sleeve is only partially screwed onto the glass or plastic vial assuring the evaporation of moisture in gas form during lyophilization cycle.

5. The connecting system according to claim 1, characterized by the lower portion of the closing and connecting plastic sleeve having annularly arranged projections which are inwardly directed for snapping connection with annular bulges around the outer surface of the neck of the glass or plastic vial, said annularly arranged projections having lateral spaces in between and providing open contact between the interior of the glass or plastic vial and its surrounding, thus guaranteeing evaporation of the moisture in gas form during lyophilization cycle.

6. The connecting system according to claim 5, characterized by a skirt-like extension of the wall of the lower portion of the closing and connecting plastic sleeve, said extension and said annularly arranged projections being designed to hold the closing and connecting plastic sleeve in position on the glass or plastic vial during lyophilization process.

* * * * *